US010246972B2

(12) United States Patent
Flight et al.

(10) Patent No.: US 10,246,972 B2
(45) Date of Patent: Apr. 2, 2019

(54) IN-RISER POWER GENERATION

(71) Applicant: Schlumberger Technology Corporation, Sugar Land, TX (US)

(72) Inventors: Kirk W. Flight, Spring, TX (US); Matthew Niemeyer, League City, TX (US); Ronald James Spencer, Houston, TX (US); John Yarnold, League City, TX (US); Jeffrey Marabella, Friendswood, TX (US); Gary Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/225,497

(22) Filed: Aug. 1, 2016

(65) Prior Publication Data

US 2016/0341014 A1 Nov. 24, 2016

Related U.S. Application Data

(62) Division of application No. 13/647,259, filed on Oct. 8, 2012, now abandoned.

(Continued)

(51) Int. Cl.

| | |
|---|---|
| ***E21B 4/02*** | (2006.01) |
| ***E21B 17/01*** | (2006.01) |
| ***E21B 33/035*** | (2006.01) |
| ***E21B 34/04*** | (2006.01) |
| ***F03B 3/04*** | (2006.01) |
| ***F03B 3/18*** | (2006.01) |
| ***E21B 41/00*** | (2006.01) |
| ***E21B 33/06*** | (2006.01) |
| ***E21B 33/064*** | (2006.01) |
| ***F03B 3/12*** | (2006.01) |

(52) U.S. Cl.

CPC ..... *E21B 41/0085* (2013.01); *E21B 4/02* (2013.01); *E21B 17/01* (2013.01); *E21B 33/035* (2013.01); *E21B 33/0355* (2013.01); *E21B 33/063* (2013.01); *E21B 33/064* (2013.01); *E21B 34/04* (2013.01); *F03B 3/04* (2013.01); *F03B 3/126* (2013.01); *F03B 3/18* (2013.01)

(58) Field of Classification Search

None

See application file for complete search history.

(56) References Cited

U.S. PATENT DOCUMENTS 5,839,508 A 11/1998 Tubel et al.
5,965,964 A * 10/1999 Skinner ..... E21B 41/0085 310/12.04

(Continued)

OTHER PUBLICATIONS

AU Application No. 2012352747, Patent Examination Report No. 1, dated Aug. 19, 2016, 3 pgs.

(Continued)

*Primary Examiner* — Matthew R Buck
*Assistant Examiner* — Douglas S Wood

(57) ABSTRACT

In-riser power generation devices and methods are utilized to generate power subsea to operate subsea devices of a subsea well system. A turbine power generator is located in fluid communication with a subsea fluid flow path of a subsea well system and the turbine power generator is operationally connected to a subsea power device.

6 Claims, 6 Drawing Sheets

Related U.S. Application Data

(60) Provisional application No. 61/576,582, filed on Dec. 16, 2011.

(56) References Cited

U.S. PATENT DOCUMENTS

| | | | | |
|---|---|---|---|---|
| 6,102,125 | A | 8/2000 | Calder | |
| 6,717,283 | B2 * | 4/2004 | Skinner | E21B 41/0085 290/43 |
| 8,779,614 | B2 * | 7/2014 | Yarnold | E21B 41/0085 290/54 |
| 8,985,967 | B2 * | 3/2015 | Gudivada | F04D 13/043 415/1 |
| 2012/0061090 | A1 * | 3/2012 | Richards | E21B 21/001 166/345 |
| 2013/0153242 | A1 | 6/2013 | Flight et al. | |

OTHER PUBLICATIONS

Examination report issued in the related GB application 1409120.1, dated Mar. 28, 2018 (4 pages).

* cited by examiner

IN-RISER POWER GENERATION

RELATED APPLICATIONS

This application claims the benefit of U.S. Provisional Application No. 61/576,582 filed on Dec. 16, 2011, and is a divisional of U.S. application Ser. No. 13/647,259, filed Oct. 8, 2012, the disclosures of which are incorporated by reference herein.

BACKGROUND

This section provides background information to facilitate a better understanding of the various aspects of the disclosure. It is to be understood that the statements in this section of this document are to be read in this light, and not as admissions of prior art.

Offshore systems (e.g., lakes, bays, seas, oceans etc.) often include a riser which connects a surface vessel's equipment to a blowout preventer stack on a subsea wellhead. Offshore systems which are employed for well testing operations also typically include a safety shut-in system which automatically prevents fluid communication between the well and the surface vessel in the event of an emergency. Typically, the safety shut-in system includes a subsea test tree which is landed inside the blowout preventer stack on a pipe string. The subsea test tree generally includes a valve portion which has one or more safety valves that can automatically shut-in the well via a subsea safety shut-in system. Hydraulic and electrical power to actuate the valves and devices of the subsea test tree is often communicated from the surface vessel by an umbilical.

BRIEF DESCRIPTION OF THE DRAWINGS

Embodiments of in-riser power generation devices and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
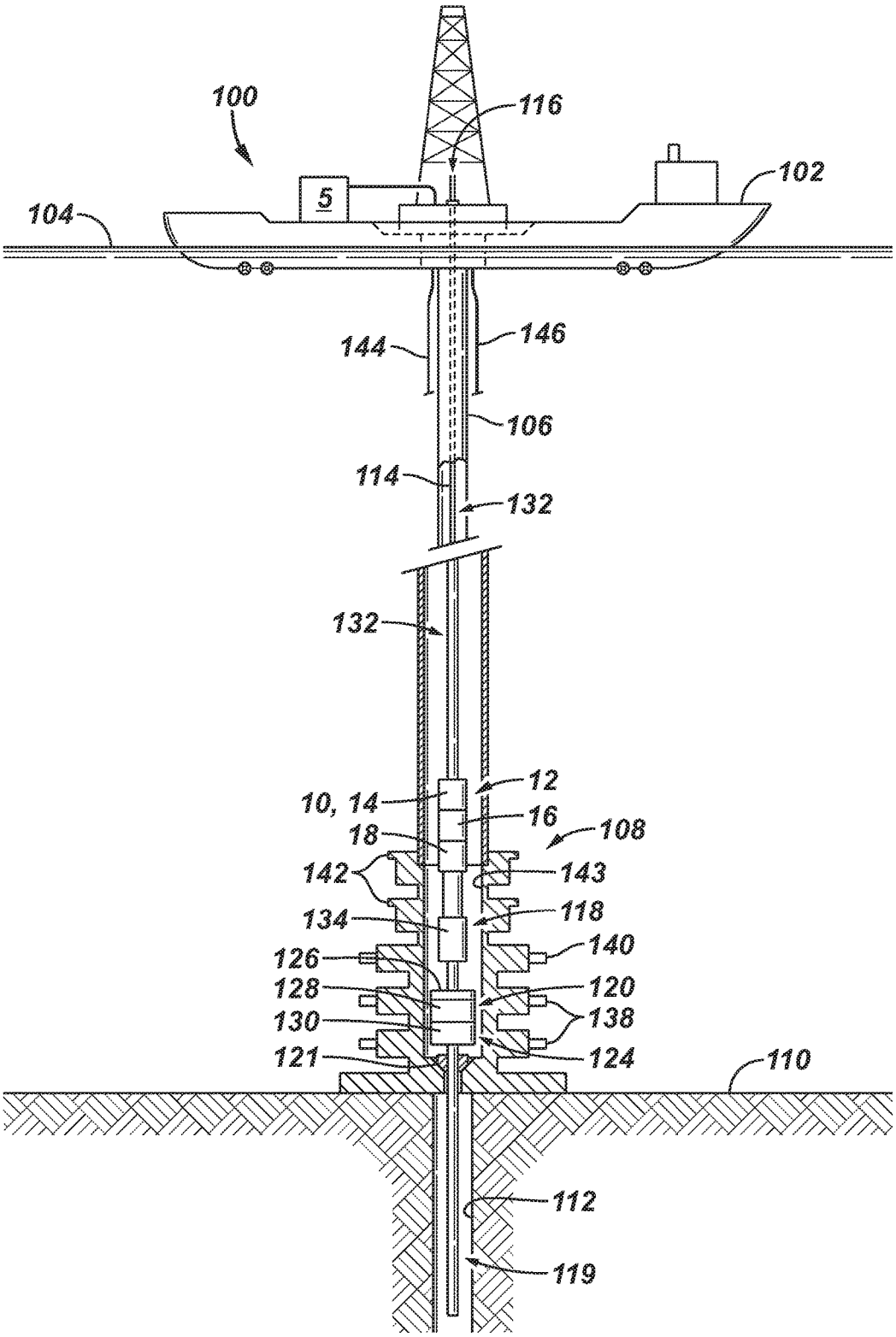
FIG. 1 illustrates an example of a subsea well system in which embodiments of in-riser power generation devices and methods can be implemented.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In-riser power generation device, methods and systems are disclosed that can be utilized to generate power (e.g., electrical, hydraulic) subsea to operate other subsea devices. The subsea generated power may be utilized to drive a subsea power device (e.g., electric motor, solenoid, valve) in a subsea well system (e.g., in the riser) and/or to charge a subsea power device (e.g., electrical battery, hydraulic accumulator). An example of a subsea well system incorporating in-riser power generation comprises a riser extending from a vessel located at a water surface to a blowout preventer stack located at a seafloor. A subsea tree landed in a passage of the blowout preventer on a landing string comprising a bore, the landing string extends in the riser from the vessel forming an annulus between the riser and the landing string. The subsea well system includes a turbine power generator operationally connected (e.g., electrically, hydraulically) to a subsea power device. The turbine power generator is in fluid communication with a subsea fluid flow path. In accordance with an embodiment, the subsea fluid flow path may be a flow path of hydraulic fluid in a subsea control system. For example, the turbine power generator may be located in hydraulic communication with the hydraulic flow path between a hydraulic power device (e.g., pump, accumulator) and a subsea hydraulically actuated device, such as, and without limitation, a valve, a latch, a tubing hanger, or a packer. The subsea fluid flow path may be within the riser flow path between the vessel and the subsea well. For example, in the axial bore extending from the well to the vessel and formed by the various devices of the subsea well system such as the landing string (e.g., tubular, tubing) and the interconnected elements of the landing string such as subs, collars, mandrels, modular units and the like, the subsea tree which is landed in the blowout preventer stack, the annulus formed between the riser and the landing string, and the annulus between the blowout preventer stack and the subsea tree. In accordance with some embodiments, the turbine power generator may be located in fluid communication with one or more fluid access lines to the passage of the blowout preventer. For example, the turbine power generator may be located proximate to the blowout preventer stack such that fluid can be circulated through one or more of the blowout preventer access lines (e.g., kill and choke lines) and across the turbine power generator.

Non-limiting examples of in-riser power generation devices in accordance with one or more embodiments comprise a sub member for connecting in the landing string providing the bore between the vessel and the blowout preventer stack and a pathway formed through the sub member to communicate fluid flow through the pathway when the sub member is connected in the landing string and the turbine power generator is disposed in fluid communication with the pathway. For example, the sub member may be a tubular joint (e.g., collar) that is made-up in the landing string when running in the hole. In one example the sub member is a circulating valve, or circulating sub type of device, wherein the turbine power generator is in fluid communication with the transverse pathway creating fluid communication between the landing string bore and the riser annulus. In another non-limiting example, the sub member may be a packer device connected in the landing string and having a pathway formed to be in co-axial communication with the riser annulus. The turbine power generator is located in fluid communication with the pathway such that the fluid flowing in the annulus between the landing string and the riser passes through the pathway and across the turbine power generator. In response to the fluid flow, the turbine power generator may provide kinetic energy for example by rotation of a shaft directly to a power generator such as a hydraulic pump or an electric alternator.

An example of a method for generating power in a subsea well system includes directing fluid flow across the turbine power generator for example by directing fluid flow from the well through the bore and/or the riser annulus. Fluid flow can be directed, for example, by pumping fluid from the pumps on the surface vessel through the landing string bore and/or the riser annulus. The fluid flow can be circulated through the riser annulus and landing string bore by operating circulating valves and/or closing valves such as an annular ram at the blowout preventer stack. In some examples, hydraulic fluid for example in the subsea control system is directed across a turbine power generator. According to one or more embodiments, fluid flow can be directed from the vessel through a blowout preventer access line and circulated through an annular region of the blowout preventer stack, across a turbine power generator, and into the riser annulus. In accordance with an embodiment, fluid may be circulated down a blowout preventer access line and circulated through a sealed annular region in the blowout preventer stack and back to the surface through another one of the blowout preventer access lines.

FIG. 1 illustrates an example of a subsea well system 100 in which embodiments of in-riser power generation devices and methods 12 can be implemented. Subsea well system 100 includes a vessel 102 which is positioned on a water surface 104 and a riser 106 which connects vessel 102 to a blowout preventer ("BOP") stack 108 on seafloor 110. A well 112 has been drilled into seafloor 110 and a tubing string 114 extends from vessel 102 through blowout preventer stack 108 into well 112. Tubing string 114 is provided with a bore 116 through which fluids (e.g., formation fluid, drilling fluid) can be conducted between well 112 and surface 104. Although vessel 102 is illustrated as a ship, vessel 102 may include any platform suitable for wellbore drilling, production, or injection operations.

Subsea tree 120 is landed in blowout preventer stack 108 on the upper portion of tubing string 114, referred to herein as landing string 132. A lower portion 119 of tubing string 114 extends into well 112 and is supported by a tubing hanger 121. Subsea tree 120 includes valve assembly 124 and a latch 126. Valve assembly 124 may act as a master control valve during testing of well 112. Valve assembly 124 may include one or more valves, such as flapper valve 128 and a ball valve 130. Latch 126 allows landing string 132 to be disconnected from subsea tree 120, for example during an emergency shutdown. Retainer valve 134 is arranged at the lower end of landing string 132 to prevent fluid in the upper portion of tubing string 114 from draining into the subsea environment when the landing string is disconnected from subsea tree 120. It should be clear that the embodiments are not limited to the particular embodiment of subsea tree 120 shown, but any other valve system that controls flow of fluids through tubing string 114 may also be used. An example of a subsea tree that may be utilized is disclosed in U.S. Pat. No. 6,293,344.

Blowout preventer stack 108 includes pipe rams 138, shear rams 140, and annular rams 142. BOP stack 108 defines a passage 143 for receiving tubing string 114. Subsea tree 120 is arranged within blowout preventer stack 108, and retainer valve 134 extends from subsea tree 120 into annular rams 142. With additional reference to FIG. 7, external fluid communication with passage 143 of BOP stack 108 is provided through BOP access lines 144, 146, which are illustrated extending along the exterior of riser 106 in FIG. 1. The BOP access lines are referred to individually as BOP kill line 144 and BOP choke line 146. High pressure drilling fluid can be pumped into the BOP stack 108 via kill line 144, for example, and fluid can be removed from the BOP stack 108 via choke line 146, for example.

Subsea well system 100 includes a safety shut-in system 118 which provides automatic shut-in of well 112 when conditions on vessel 102 or in well 112 deviate from preset limits. Safety shut-in system 118 includes subsea tree 120 and a subsea control system 10 to operate various devices of subsea tree 120 such as, and without limitation, valves 128, 130, retainer valve 134 and latch 126. Subsea control system 10 can be utilized to operate, for example, valves 128, 130 during well testing or other production or injection operations as well during emergency shutdown. In the illustrated embodiment, subsea control system 10 is a modular unit that includes a subsea hydraulic power unit 14 (e.g., accumulators, electric pumps, valves, hydraulic and electrical circuits, and electronic processors) to operate the hydraulic valve actuations, for example, of subsea tree 120 control systems, safety valves 128, 130, latch 126, tubing hanger 121, and other downhole valves and control systems. Subsea control system 10 and subsea hydraulic power unit 14 include a subsea electrical source 16 (e.g., power device, battery) that may electrically power one or more devices of subsea hydraulic power unit 14. The modular units can be connected within landing string 132 to form a continuous axial bore 116 between vessel 102 and well 112.

Each hydraulic valve, or device, actuation reduces the available hydraulic supply pressure of subsea hydraulic power unit 14 and the electrical power stored at subsea electrical source 16. Subsea well system 100 includes an in-riser power generation device 12 to recharge the electrical and/or hydraulic power of subsea control system 10. In accordance with one or more embodiments, in-riser power generation device 12 includes a turbine power generator 18 operationally connected to subsea control system 10. Turbine power generator 18 is located subsea within the closed loop fluid system of subsea well system 100 to generate power in response to the flow of fluid 40, 46 (e.g., well fluid, drilling fluid, hydraulic fluid) across turbine power generator 18. Turbine power generator 18 can be disposed in various fluid paths locations within subsea well system 100. For example, and without limitation, turbine power generator 18 may be disposed within the fluid flow path of bore 116 of landing string 132, the annulus 150 between riser 106 and tubing string 114, the annular region 151 between BOP stack 108 and subsea tree 120, the subsea hydraulic fluid control circuit 19 (e.g., hydraulic fluid flow path, supply conduit 22 and/or return conduit 24), pathways 28, 40, 50, conduit 52, and one or both of the BOP access lines 144, 146.

Figure 2:
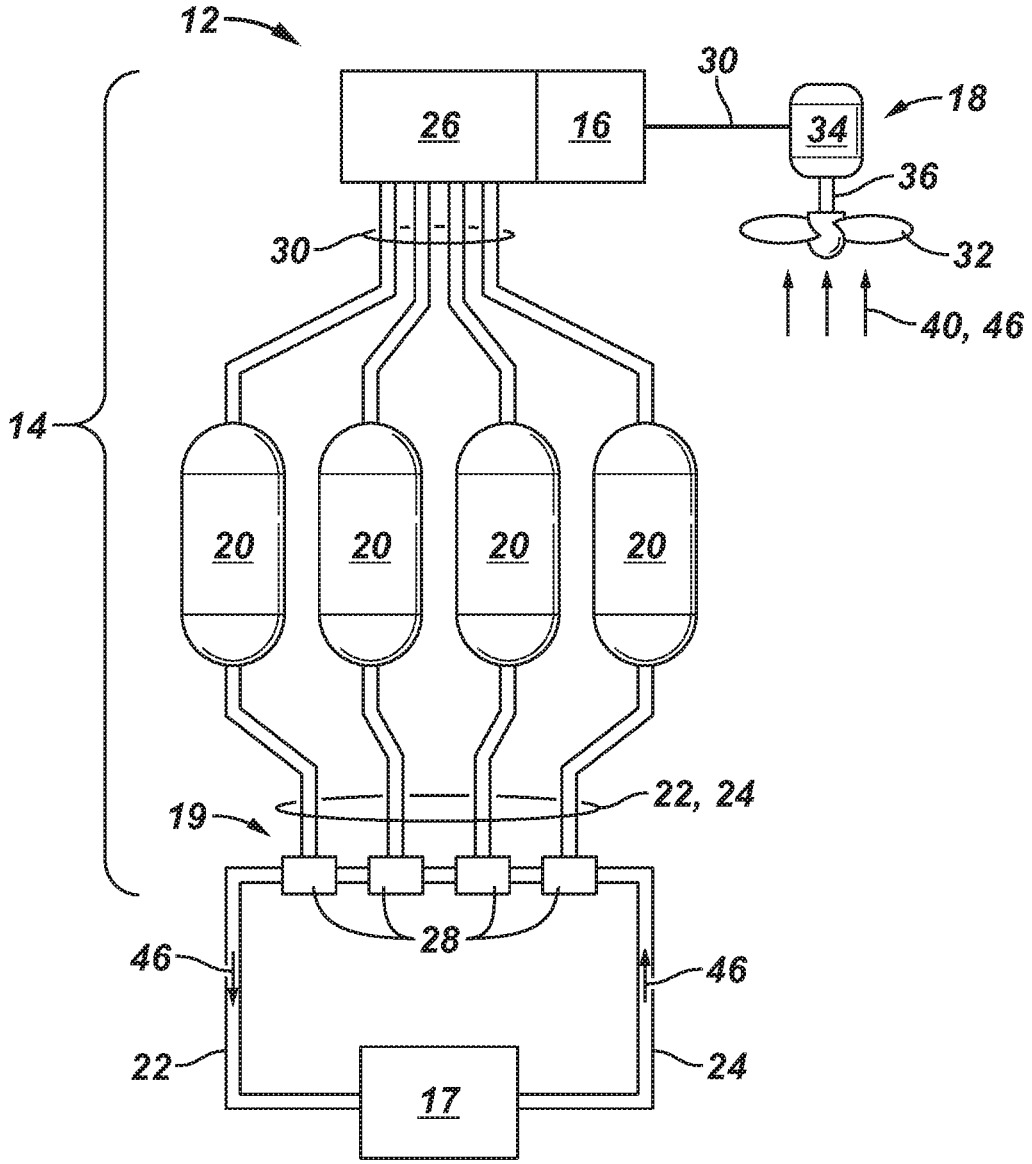
FIG. 2 is a schematic diagram of an example of in-riser power generation device in accordance with one or more embodiments.

FIG. 2 is a schematic diagram of an embodiment of in-riser power generation device 12. With reference to FIGS. 1 and 2, subsea hydraulic power unit 14 includes one or more subsea hydraulic power devices 20 (e.g., pumps, accumulators) in a hydraulic control circuit generally identified by the numeral 19. For the purpose of brevity and clarity in the description, the subsea hydraulically actuated devices, for example, and without limitation, latch 126 and valves 128, 130, 134 of subsea tree 120, are identified generally with the reference numeral 17. In the depicted embodiment, subsea hydraulic power unit 14 comprises more than one subsea hydraulic power device 20 in fluid communication with the subsea hydraulically actuated devices 17 for example via supply conduit 22 and/or return conduit 24. Each subsea hydraulic power device 20 may also be in fluid communication with one or more of the other subsea hydraulic power devices 20 through supply and return conduits 22, 24. Each of supply conduit 22 and return conduit 24 may include more than one conduit (e.g., flow path).

A subsea electrical source 16 is electrically coupled to a subsea control circuit 26. A conductor 30 (e.g., umbilical) may include multiple paths to conduct hydraulic power, electrical power, and control signals. Electrical signals and power can be transmitted between subsea control circuit 26 and one or more of the subsea hydraulic power devices 20, valves 28, and subsea tree 120 for example via conductor 30. Although not specifically illustrated in the figures, subsea control circuit 26 may be connected to sensors located within subsea well system 100. Communication of hydraulic fluid and pressure through conductor 30 and supply and return conduits 22, 24 may be controlled via subsea control circuit 26 and valves 28 (e.g., solenoids). For example, hydraulic supply pressure may be communicated from a first one of the subsea hydraulic power devices 20 through supply conduit 22 to a subsea hydraulically actuated device 17, thereby operating subsea hydraulically actuated device 17 from a first position to a second position and hydraulic fluid may be transmitted from subsea hydraulically actuated device 17 through return conduit 24 to a second one of the hydraulic pressure devices 20 for example for storage as opposed to venting the hydraulic fluid to the environment.

Turbine power generator 18 is depicted in FIG. 2 operationally coupled to subsea hydraulic power unit 14 via conductor 30 (e.g., conduits, wire, inductive coupler, wired pipe) to regenerate the power supply of subsea hydraulic power unit 14. In accordance with one or more embodiments, turbine power device 18 includes an impeller 32 rotationally connected by shaft 36 to a power generator, or power conversion device, referred to as a generator 34 herein. In some embodiments, generator 34 is an alternator that converts the rotation of shaft 36 into electrical power. In some embodiments, generator 34 is a pump that produces hydraulic power (i.e., pressure) in response to the rotating shaft. For example, shaft 36 may be connected to, or may be, the drive shaft of the pump. In some embodiments, generator 34 is representative of a pump-type of hydraulic power device 20. In some embodiments, generator 34 produces electrical power that drives an electric motor of a hydraulic pump.

Figure 3:
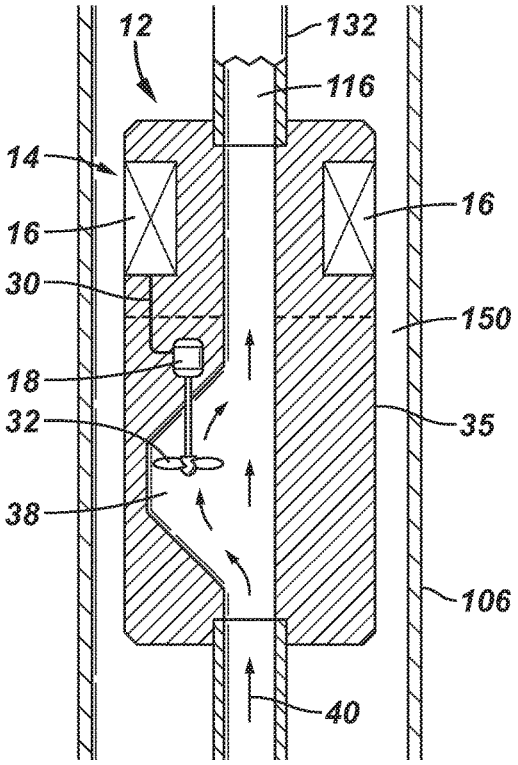
FIGS. 3-8 illustrate examples of turbine power generator locations within a subsea well system in accordance with in-riser power generation embodiments.

FIG. 3 illustrates a turbine power generator 18 located in fluid communication with bore 116 of landing string 132 in accordance with an embodiment of in-riser power generation device 12. Turbine power generator 18 is incorporated in a generation sub 35 (e.g., tubular joint, tubular collar), or a section of landing string 132, having an oversized section of bore 116 forming a pocket 38 (i.e., pathway) that is offset axially from bore 116. Impeller 32 is disposed in pocket 38. Generation sub 35 is illustrated connected within landing string 132 for example between subsea tree 120 and subsea hydraulic power unit 14 such that bore 116 extends continuously through landing string 132. Fluid indicated by the arrow 40, flows through bore 116 of landing string 132 and across impeller 32 located in pocket 38 causing turbine power generator 18 to generate subsea power. The fluid 40 flowing in bore 116 may be formation fluid being produced for example during well testing. It is to be understood that fluid flow in either direction through bore 116 can operate turbine power generator 18. For example, annular ram 142 may be closed and fluid 40 can be circulated from vessel 102 down one of bore 116 or annulus 150 and back up to the surface through the other of annulus 150 and bore 116 to generate subsea power and to regenerate subsea hydraulic power unit 14.

Figure 4:
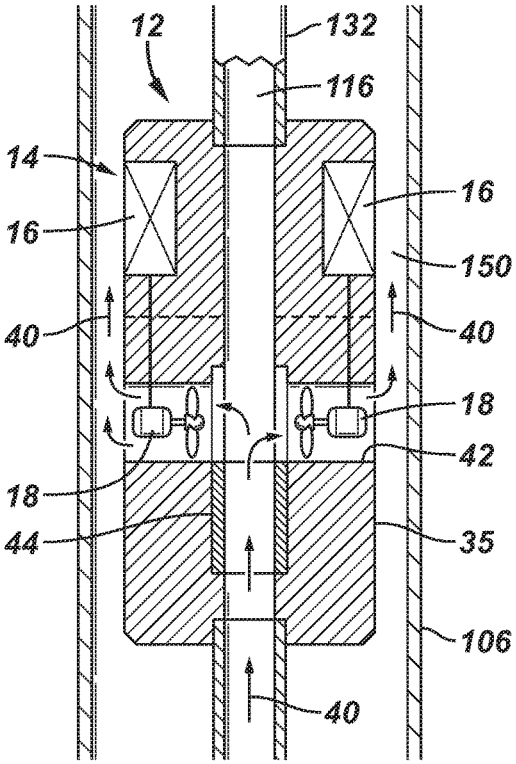

FIG. 4 illustrates a turbine power generator 18 located in fluid communication with bore 116 and riser annulus 150 of landing string 132 in accordance with an embodiment of in-riser power generation device 12. In the illustrated embodiment, turbine power generator 18 is incorporated in a circulation valve type of generation sub 35. Turbine power generator 18, or at least impeller 32, is positioned in a transverse pathway 42 formed through a sidewall of generation sub 35 providing fluid communication between bore 116 of generation sub 35 and the exterior of generation sub 35, i.e., annulus 150. A valve member 44 (e.g., sliding sleeve) is moveably positioned to open and close pathway 42. When the circulating valve type generation sub 35 is connected within landing string 132, and valve member 44 is in the open position, fluid flow 40 can be circulated between bore 116 and annulus 150 through pathway 42 and across impeller 32. Fluid 40 is illustrated in FIG. 4 flowing from the well in bore 116 and across pathway 42 into annulus 150 and toward the surface. Similarly, fluid 40 can be circulated from riser annulus 150 through pathway 42 into bore 116. For example and with additional reference to FIG. 1, to regenerate power of subsea hydraulic power unit 14, formation fluid 40 is directed through bore 116 toward the surface, valve member 44 is moved to the open position, and formation fluid 40 is circulated through pathway 42 into annulus 150. Valve member 44 may be operated for example by subsea control system 10 via subsea hydraulic power unit 14. The electrical or hydraulic power generated by turbine power generator 18 when circulating fluid 40 can be conducted to recharge the electrical and/or hydraulic power supply of subsea hydraulic power unit 14. For example, the subsea generated electrical power can be conducted to subsea electrical source 16 for storage and/or conducted to drive an electric motor of a pump type of subsea hydraulic power device 20 (FIG. 2) to recharge the hydraulic supply pressure of another one of the subsea hydraulic power devices of subsea hydraulic power unit 14. In another example, subsea generated hydraulic power may be conveyed for example via conductor into an accumulator type of subsea hydraulic power device.

Figure 5:
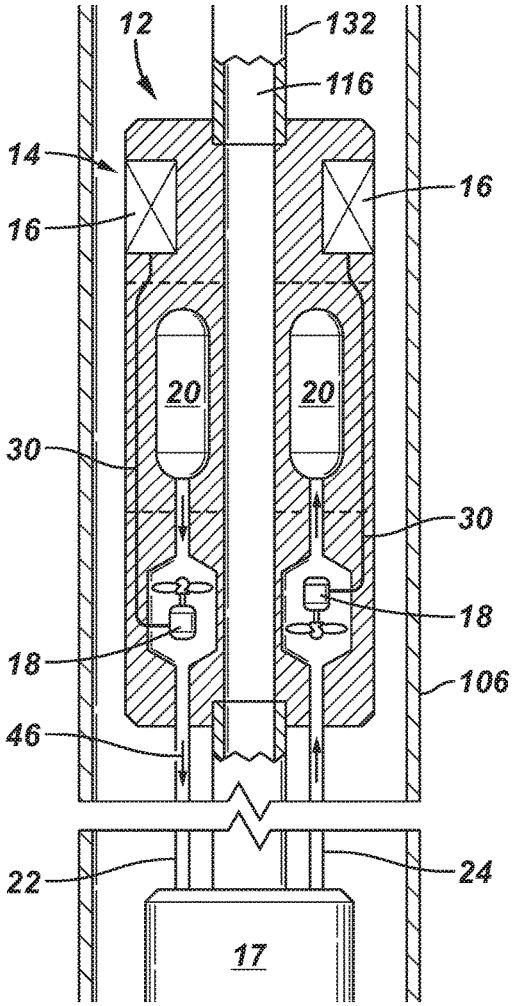

FIG. 5 illustrates a turbine power generator 18 in fluid communication with the hydraulic fluid circuit 19 (FIG. 2) of subsea hydraulic power unit 14 in accordance with an embodiment of in-riser power generation device 12. For example, a turbine power generator 18, or at least the impeller of turbine power generator 18, is disposed within hydraulic supply conduit 22 and/or hydraulic fluid return conduit 24. In the illustrated embodiment, two turbine power generators 18 are utilized for redundancy. For example, when actuating a subsea hydraulically actuated device 17 (e.g., latch 126, valves 128, 130, 134), hydraulic fluid 46, identified by the arrow, is communicated from a first subsea hydraulic power device 20 through supply conduit 22 to subsea hydraulically actuated device 17. Turbine power generator 18 located in fluid communication with supply conduit 22 generates subsea power when hydraulic fluid 46 is communicated to subsea hydraulically actuated device 17. When hydraulic fluid 46 is communicated from subsea hydraulically actuated device 17 via return conduit 24, subsea power is generated by the turbine power generator 18 in fluid communication with return conduit 24. The electrical and/or hydraulic power supply of subsea hydraulic power unit 14 can be regenerated (i.e., recharged) when a subsea hydraulically actuated device 17 (e.g., tubing hanger 121, latch 126, valves 128, 130, 134) is operated. In the illustrated embodiment, hydraulic fluid 46 is returned to a subsea hydraulic power device 20 that serves as a reservoir, or tank, for storage of hydraulic fluid. With additionally reference to FIG. 2, the stored hydraulic fluid can be supplied to a pump-type of subsea hydraulic power device 20 and pumped under pressure into another one of the other subsea hydraulic power devices 20, for example the first subsea hydraulic power device 20 identified above, or pumped through supply conduit 22 to actuate a subsea hydraulically actuated device 17.

Figure 6:
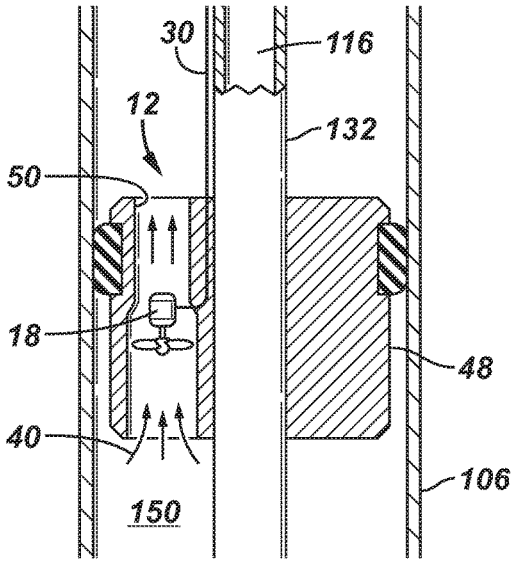

FIG. 6 illustrates a turbine power generator 18 located in riser 106 and in fluid communication with annulus 150 in accordance with an embodiment of in-riser power generation device 12. Turbine power generator 18 is incorporated within a packer 48 in the depicted embodiment. For example, turbine power generator 18 may be integral with packer 48. Turbine power generator 18, or at least the impeller, is disposed in a pathway 50 extending through packer 48 and axially aligned with annulus 150 between riser 106 and landing string 132. Packer 48 can be, for example, an inflate element or a rubber element that is squeezed to activate. Packer 48 may be run into riser 106 on landing string 132.

Packer 48 only needs to hold the differential pressure built up across turbine power generator 18 plus any fluid pressure drop through the tool. The differential pressure may be 100 to 200 psi for example. The sealing pressure of packer 48 need only be sufficient to divert most of fluid 40 flow into pathway 50 and the inlet of turbine power generator 18. Leakage across packer 48 is not a problem.

Flow 40 flow through annulus 150 flows through pathway 50 and across turbine power generator 18. The subsea generated power is conducted, for example via conductor 30, to subsea hydraulic power unit 14 (FIG. 1). The flow of fluid across turbine power generator 18 is not restricted to the direction of fluid flow illustrated by the arrow in FIG. 6.

Figure 7:
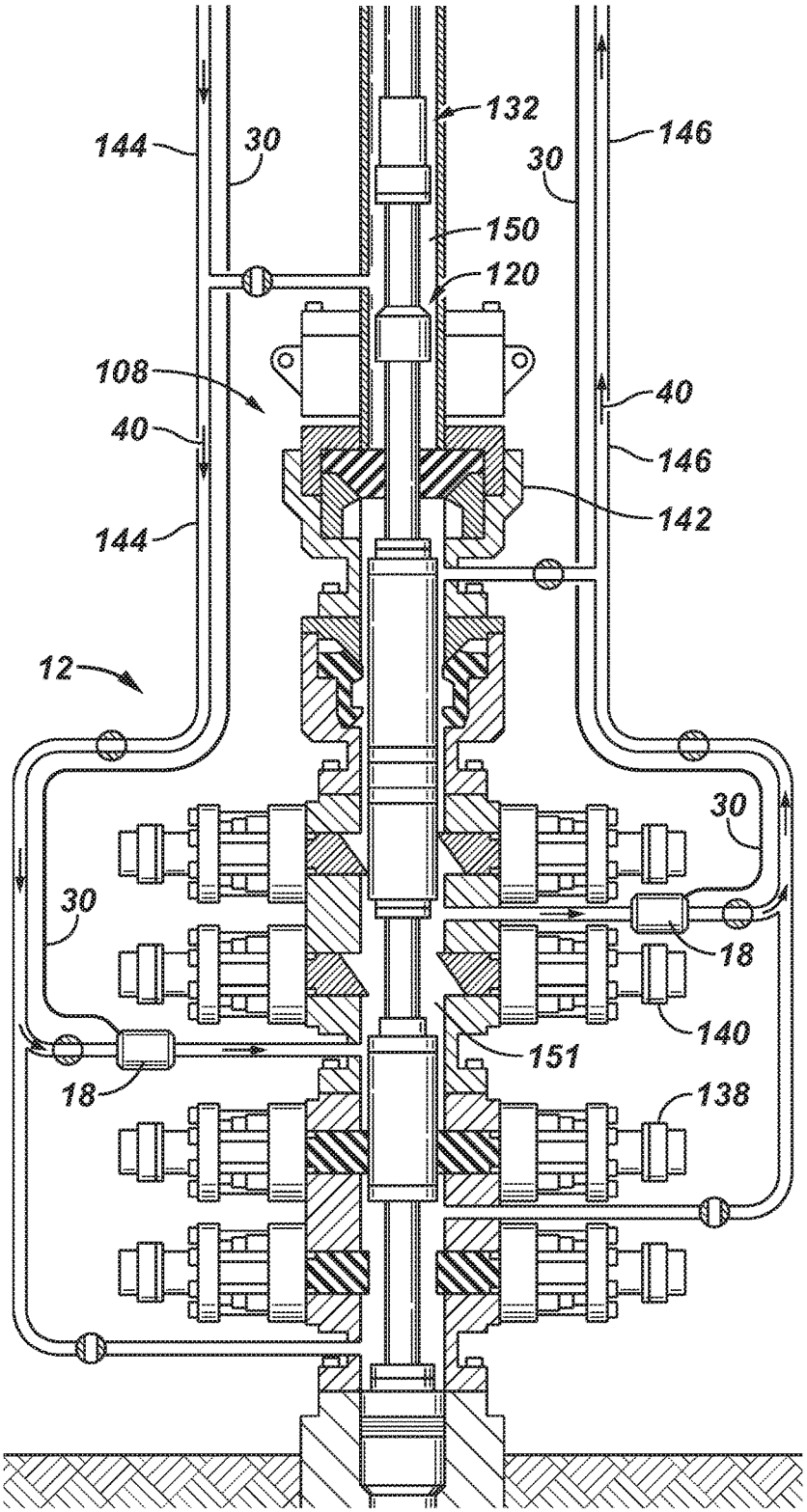

Refer now to FIG. 7 illustrating a turbine power generator 18 located in fluid communication with the BOP access lines 144, 146 at BOP stack 108 in accordance with an embodiment of in-riser power generation device 12. In accordance with embodiments, one or more turbine power generators 18 are in fluid communication with a BOP kill line 144 and a BOP choke line 146 through annular region 151 in the sealed riser mandrel. In the depicted embodiment, a first turbine power generator 18 is disposed at BOP stack 108 in fluid communication with a BOP kill line 144 and a second turbine power generator 18 is disposed at BOP stack 108 in fluid communication with BOP choke line 146. Two or more turbine power generators 18 may be provided for redundancy. With additional reference to FIGS. 1 and 2, an example of operation of in-riser power generation device and method 12 is now described. Annular ram 142 is closed sealing annular region 151 below annular ram 142 from the annulus 150 above annular ram 142. One of the pipe rams 138 may also be closed to define the annular region 151 between the closed pipe ram 138 and the closed annular ram 142. BOP kill and choke lines 144, 146 that are ported to annular region 151 are opened (e.g., valves 56) and fluid 40 (e.g., drilling fluid) is pumped from system 5 of vessel 102 down BOP kill line 144 and circulated through annular region 151 into BOP choke line 146 and back to the surface. Flowing fluid 40 through the BOP kill and choke lines 144, 146 that are in fluid communication with a turbine power generators 18 results in subsea power being generated and conducted, for example via conductor 30 to subsea hydraulic power unit 14 (FIGS. 1, 2).

Figure 8:
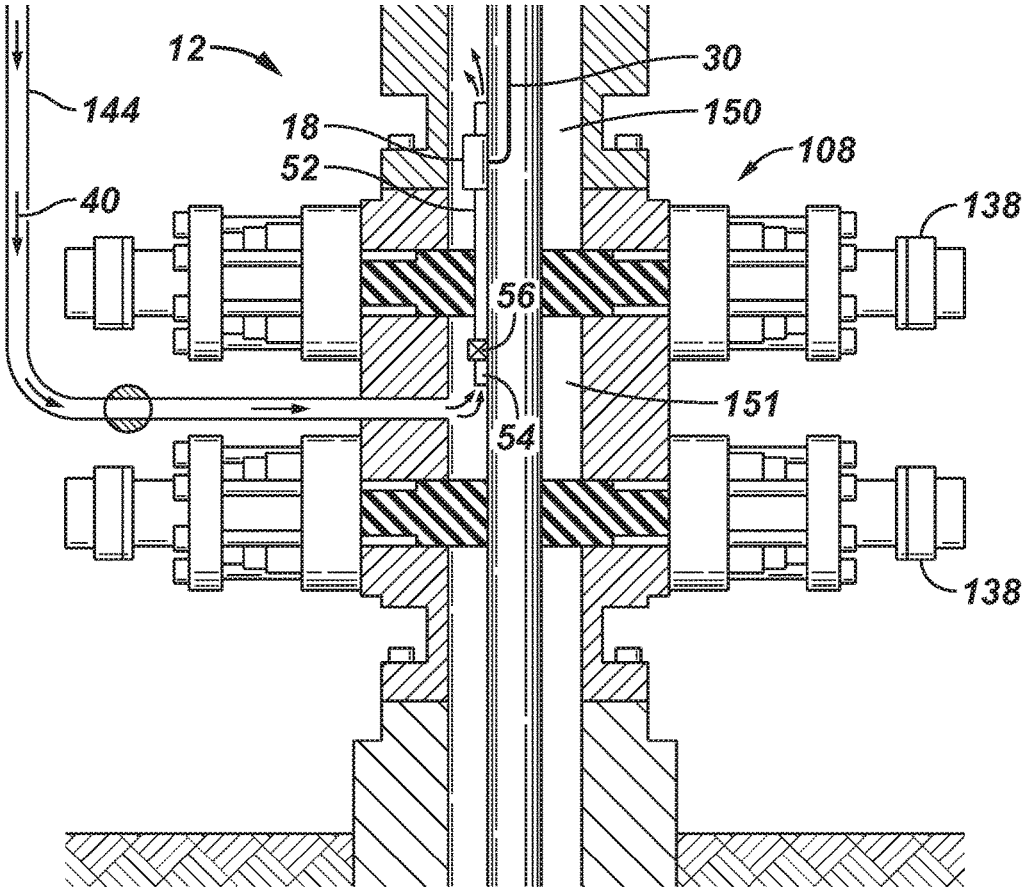

FIG. 8 illustrates a turbine power generator 18 located in fluid communication with an annular region 151 of BOP stack 108 in accordance with an embodiment of in-riser power generation device 12. In the disclosed embodiment, annulus 151 is an annular region formed between two closed BOP annular rams (e.g., pipe rams 138 and/or annular rams 142). For example, in the FIG. 8 annulus 151 is sealed between the pair of pipe rams 138. A conduit 52 extends from an inlet 54 located in annular region 151, across a ram seal (e.g., top pipe ram 138) to turbine power generator 18 located above the sealed annular region 151. Fluid 40 is pumped from surface vessel 102 through a BOP access line, for example BOP kill line 144, into annular region 151 and through conduit 52 and across turbine power generator 18. Electrical power generated by turbine power generator 18 may be conducted to subsea hydraulic control unit 14 (FIGS. 1, 2). As illustrated in FIG. 8, a valve 56 is provided within conduit 52 to block fluid flow there through when necessary.

Although only a few example embodiments have been described in detail above, those skilled in the art will readily appreciate that many modifications are possible in the example embodiments without materially departing from the invention. Accordingly, all such modifications are intended to be included within the scope of this disclosure as defined in the following claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas the screw employs a helical surface, in the environment unfastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method of generating power in a subsea well system, comprising:

closing at least a pair of rams of a blowout preventer stack to form a sealed annular region between the pair of rams;

positioning at least one turbine power generator above the sealed annular region;

connecting the sealed annular region to the at least one turbine power generator by a conduit across the closed pair of rams;

directing fluid into the sealed annular region and across the at least one turbine power generator; and generating power in response to the fluid flow across the turbine power generator.

2. The method of claim 1 further comprising directing the generated power to a subsea hydraulic control unit.

3. The method of claim 2 wherein the fluid acts upon a first turbine power generator during fluid communication from the conduit past the first turbine power generator.

4. The method of claim 1 wherein fluid is directed into the sealed annular region by a blowout preventer access line.

5. The method of claim 4 wherein the blowout preventer access line is a kill line.

6. The method of claim 1 wherein the at least one turbine power generator comprises an impeller.

* * * * *